US006645364B2

(12) United States Patent
Calvert et al.

(10) Patent No.: US 6,645,364 B2
(45) Date of Patent: Nov. 11, 2003

(54) ELECTROPLATING BATH CONTROL

(75) Inventors: Jeffrey M. Calvert, Acton, MA (US); Robert A. Binstead, Marlborough, MA (US)

(73) Assignee: Shipley Company, L.L.C., Marlborough, MA (US)

( * ) Notice: Subject to any disclaimer, the term of this patent is extended or adjusted under 35 U.S.C. 154(b) by 55 days.

(21) Appl. No.: 10/046,507

(22) Filed: Oct. 19, 2001

(65) Prior Publication Data

US 2002/0060157 A1 May 23, 2002

Related U.S. Application Data

(60) Provisional application No. 60/242,348, filed on Oct. 20, 2000.

(51) Int. Cl.[7] ..... C25D 21/12; C25D 5/00

(52) U.S. Cl. ..... 205/81; 205/82; 205/101; 436/173

(58) Field of Search ..... 205/81, 84, 82, 205/101; 204/228.1, 228.6, 229.2, 232, 237, DIG. 13; 436/173

(56) References Cited

U.S. PATENT DOCUMENTS

| | | | | |
|---|---|---|---|---|
| 4,102,756 A | * | 7/1978 | Castellani et al. | 205/82 |
| 4,132,605 A | | 1/1979 | Tench et al. | |
| 4,917,774 A | | 4/1990 | Fisher | |
| 5,223,118 A | | 6/1993 | Sonnenberg et al. | |
| 5,352,350 A | * | 10/1994 | Andricacos et al. | 205/101 |
| 5,368,715 A | * | 11/1994 | Hurley et al. | 205/82 |
| 6,458,262 B1 | * | 10/2002 | Reid | 205/82 |

FOREIGN PATENT DOCUMENTS

DE 199 11 447 A1 3/1999

* cited by examiner

*Primary Examiner*—Roy King
*Assistant Examiner*—Wesley A. Nicolas
(74) *Attorney, Agent, or Firm*—S. Matthew Cairns

(57) ABSTRACT

Disclosed is a method of analyzing components in an electroplating bath. Also disclosed is a method of controlling electroplating baths by monitoring the components of the plating bath in real-time.

10 Claims, 3 Drawing Sheets

ELECTROPLATING BATH CONTROL

This application claims the benefit of provisional application No. 60/242,348, filed Oct. 20, 2000.

BACKGROUND OF THE INVENTION

The present invention relates generally to the field of control of electroplating baths. In particular, the present invention relates to the control of electroplating baths using real-time monitoring of the bath components.

Electroplating baths for copper and other metals are typically aqueous, or mostly aqueous, solutions composed of metal compounds or salts, ionic electrolytes, and various additives such as brighteners, suppressors, levelers, accelerators, surfactants, defoamers, and the like. These electroplating baths, which are used to deposit metals or semimetals such as copper, nickel, gold, palladium, platinum, ruthenium, rhodium, tin, zinc, antimony, or alloys such as copper-tin (brass), copper-zinc (bronze), tin-lead, nickel-tungsten, cobalt-tungsten-phosphide, and the like are used in applications such as the fabrication of electronic devices and components, such as conductive circuits for printed circuit boards, multichip modules, semiconductor devices and the like.

Reliable operation of these electroplating baths in a manufacturing process requires that methods of analysis are employed to determine the appropriate concentrations of the reagent species for bath startup. These analysis methods are also used to determine the concentrations of species in the bath during operation, often with on-line feedback control, to allow the components of the bath to be monitored and adjusted as required to maintain concentrations within predetermined limits Bath analysis methods are also used to determine the chemical identity and concentrations of species that are produced in the bath as a consequence of chemical and electrochemical reactions that take place during bath operation and/or idling. Such bath analysis methods include cyclic voltammetric stripping ("CVS"), cyclic pulse voltammetric stripping ("CPVS"), open circuit potential ("OCP") measurement, AC impedance, high pressure liquid chromatography ("HPLC"), ion chromatography ("IC"), titrimetry, gravimetric analysis, optical spectroscopy, and the like. See, for example, U.S. Pat. No. 5,223,118 (Sonnenberg et al.) and U.S. Pat. No. 4,917,774 (Fisher). Chromatographic techniques such as HPLC and IC are useful laboratory methods, for analyzing various components of plating baths, but they have not been widely implemented in commercial bath analysis systems. Titrimetric and gravimetric techniques are more widely used than chromatographic methods, but these methods require the use of various additional chemistries (titrants, complexants, precipitants) and are difficult to implement in an on-line, real-time configuration.

Electrochemical techniques such as CVS and CPVS have been most widely used in commercial applications for analysis of plating baths because these methods are reliable and are particularly well-suited to on-line, real-time analysis. However, the electrochemical techniques are also limited in several aspects. Each technique measures a current flow in response to a changing applied potential across an electrochemical cell containing the plating solution. The current is a response that reflects the aggregate of all of the electrochemical reactions that occur in the cell at a given potential. These techniques are generally unable to distinguish between different or competing reactions that occur at the same potential. These electrochemical techniques also are not specific to particular chemical species in the solution, so the changing concentration of individual species cannot be directly measured.

In the operation of commercial electroplating baths, it is very important to be able to measure and control the individual components of the plating bath, particularly the organic additives. These materials are typically present in the plating bath in small amounts relative to the metal salts or electrolytes. However, the additives play a major role in controlling both the characteristics of the deposition process such as the plating rate, as well as the physical properties of the deposit such as uniformity, grain size, ductility, stress, surface roughness, and the like. In a typical electroplating bath two, three, or even more additives may be deliberately formulated into the bath to provide the desired plating characteristics and deposit properties. Techniques such as CVS, CPVS, or OCP can only measure the overall electrochemical behavior of a plating bath but can not independently determine the concentrations of the various additive species in the bath without resorting to complex analysis schemes that involve the use of special calibration solutions or other similar approaches. Additionally, additives are often small organic molecules or polymers that either undergo electrochemical, chemical, or other reactions (such as surface adsorption) under the applied potential conditions at which the electroplating process takes place. These reactions can change some portion of the original additive species to different species. The relative proportions and chemical or electrochemical activities of these new species can change over time, depending on the conditions of use of the plating bath. The changing concentrations of species and their activities affects the electrochemical behavior of the plating bath and ultimately can affect the properties of the deposits produced from the bath. It is very difficult to determine the nature of these reaction products in the electroplating bath by conventional electrochemical methods or measure their changing concentrations over time, yet these species may actually be the most important ones to measure and control in order to optimize the properties of the electrodeposited films.

Differential electrochemical mass spectrometry ("DEMS") has been used to detect various chemical species, such as the evolution of carbon dioxide gas from an electrochemical reaction. This technique has never been applied to the analysis of organic components in an electroplating bath.

Thus, there is a continuing need for a method that can more accurately determine the specific nature of the additive species and their reaction products that are present in an electroplating bath and to measure their concentrations on-line, in real-time, and over time as the electroplating reaction proceeds.

SUMMARY OF THE INVENTION

It has been surprisingly found that the present method provides on-line, real-time analysis of electroplating bath components. According to the present method, all organic additives in an electroplating bath may be monitored simultaneously.

In one aspect, the present invention provides a method for determining the level of components in an electroplating bath including the steps of: a) obtaining a plurality of solutions wherein each solution has known and different concentrations of an analyte, but where the quantity of the analyte in each solution differs from the quantity in the other solutions; b) providing an apparatus having a first chamber and a second chamber, the first chamber being separated from the second chamber by a liquid-impermeable, gas-permeable membrane; c) introducing each solution individually into the first chamber and carrying out a predetermined sequence of steps including: i) reducing the pressure in the second chamber relative to the first chamber to produce a gas stream; ii) directing at least a portion of the gas stream to a mass spectrometer; iii) measuring a characteristic mass/charge peak for the analyte; d) for each solution, correlating the quantity of analyte with the measurement of the characteristic mass/charge peak; e) introducing a bath having an unknown quantity of the analyte into the first chamber; f) performing the predetermined sequence of steps; and g) choosing from the correlation in step d) a quantity of the analyte which corresponds to the recorded characteristic mass/charge peak measurement for the analyte.

In a second aspect, the present invention includes an electroplating system including an electroplating tank containing an electroplating bath, the tank having an outlet for directing a portion of the electroplating bath to an apparatus for determining the level of components in the electroplating bath, the apparatus including a first chamber separated from a second chamber by a liquid-impermeable, gas-permeable membrane, a means for reducing the pressure in the second chamber relative to the first chamber to produce a gas stream, and a means for directing at least a portion of the gas stream to a mass spectrometer.

In a third aspect, the present invention provides a method for electrolytically depositing metal on a substrate including the steps of: a) contacting the substrate with an electroplating bath including a source of metal ions, and electrolyte and one or more organic additives; b) subjecting the electroplating bath to sufficient current density for a period of time sufficient to deposit a desired thickness of metal on the substrate; and c) monitoring the one or more organic additives by i) obtaining a plurality of solutions wherein each solution has known and different concentrations of an organic additive, but where the quantity of the organic additive in each solution differs from the quantity in the other solutions; ii) providing an apparatus having a first chamber and a second chamber, the first chamber being separated from the second chamber by a liquid-impermeable, gas-permeable membrane; iii) introducing each solution individually into the first chamber and carrying out a predetermined sequence of steps including: aa) reducing the pressure in the second chamber relative to the first chamber to produce a gas stream; bb) directing at least a portion of the gas stream to a mass spectrometer; cc) measuring a characteristic mass/charge peak for the organic additive; iv) for each solution, correlating the quantity of organic additive with the measurement of the characteristic mass/charge peak; v) introducing a portion of the electroplating bath having an unknown quantity of the organic additive into the first chamber; vi) performing the predetermined sequence of steps; and vii) choosing from the correlation in step iv) a quantity of the organic additive which corresponds to the recorded characteristic mass/charge peak measurement for the organic additive.

DETAILED DESCRIPTION OF THE INVENTION

The present invention uses differential electrochemical mass spectrometry ("DEMS") to analyze one or multiple organic components in an electroplating solution. This method offers several advantages over conventional methods of analyzing electroplating baths. Very low levels of organic species may be determined using this technique, such as below ppm levels, e.g. ≦0.5 ppm, ≦0.1 ppm, ≦0.05 ppm and the like. Multiple organic species in an electroplating bath may be monitored according to the present invention unlike conventional techniques which analyze only for a limited number of components, e.g. one or two. The limit on organic species that can be analyzed is the number of channels possessed by the mass spectrometer used. The use of a mass spectrometer provides real-time, multichannel analysis of the individual species with a typical mass resolution of less than 1 atomic mass unit. The present invention provides highly specific information about both the mass spectral identity of additives in the plating bath, but also the time course of their concentrations. According to the present invention, the spectral identity and buildup of reaction products of one or more of the organic additives can be determined while the electroplating bath remains in operation. Such information is extremely important to the analysis and control of electroplating baths for use in the manufacture of electronic devices.

Figure 1:
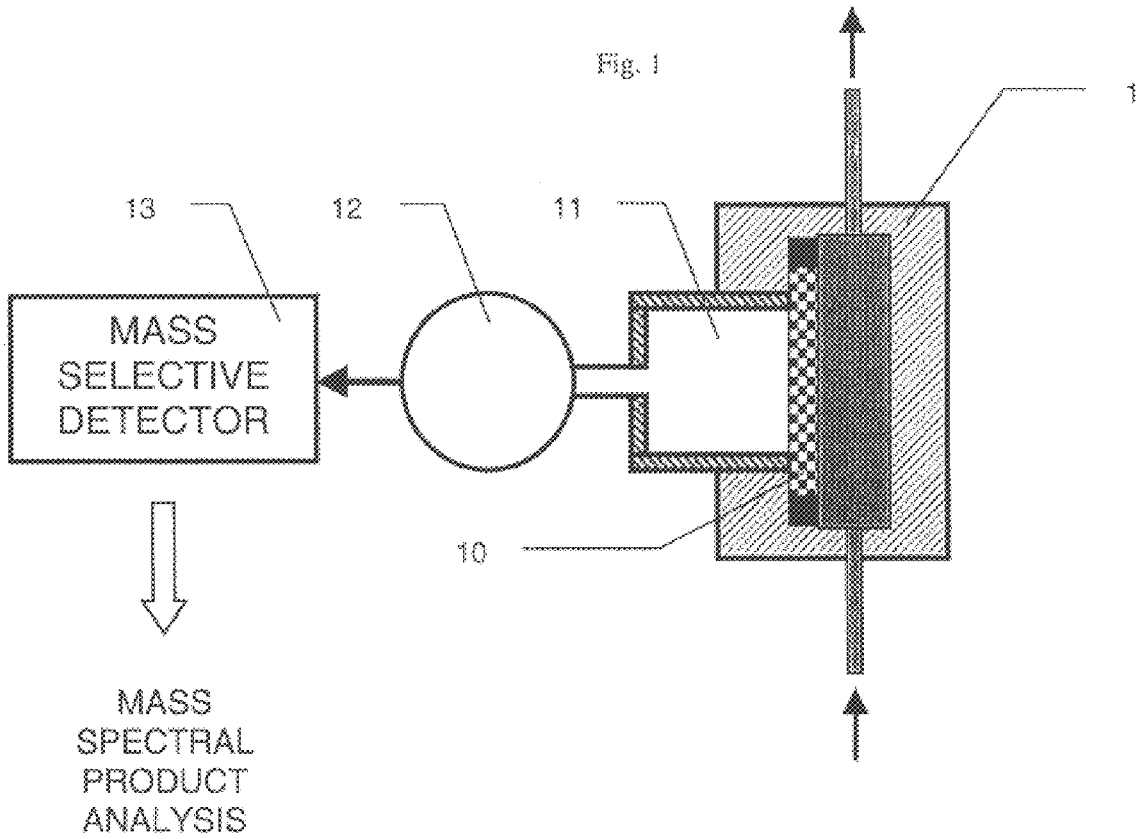
FIG. 1 illustrates an apparatus useful in the invention, not to scale.

FIG. 1 illustrates an apparatus useful in the invention, not to scale. The apparatus has a first chamber 1, a second chamber 11 and a liquid-impermeable, gas-permeable membrane 10 separating the first and second chambers. The second chamber 11 is connected to a vacuum pump 12. The vacuum pump reduces the pressure in the second chamber 11 relative to the first chamber 1 thus producing a gas flow from the first chamber 1 through the membrane 10 into the second chamber 11. At least a portion of the gas stream is directed to a mass selective detector or mass spectrometer 13. The mass selective detector is used to perform mass spectral analysis of the components of the gas stream.

The first chamber holds the solution to be analyzed. Preferably, the first chamber is constructed of chemically inert, gas-tight, electrically non-conductive materials. Suitable materials for the first chamber include polymer resins such as poly(tetrafluoroethylene) or polyetherketone. The liquid-impermeable, gas-permeable membrane may be of any suitable material that does not react with or adversely affect the components of the solution to be analyzed. The membrane material is chosen such that it is permeable to the organic components of the solution to be analyzed. Preferably, the membrane is thin. The second chamber may be a vessel or a sealed connection between the membrane and the vacuum system. One or more vacuum pumps may be successfully utilized and may be connected in series. Preferably, a high vacuum is applied to the second chamber. Such vacuum reduces the pressure of the second chamber relative to the first chamber. Thus, volatile components (i.e. organic additives) of the solution to be analyzed pass through the membrane to produce a gas stream. Such gas stream is then directed to the mass selective detector. Any suitable commercially available mass selective detector may be used in the present invention such as a quadrupole mass spectrometer. It will be appreciated that the vacuum system of the mass selective detector may apply sufficient vacuum to the second chamber to reduce its pressure relative to the first chamber without the need for a separate vacuum pump.

Figure 2:
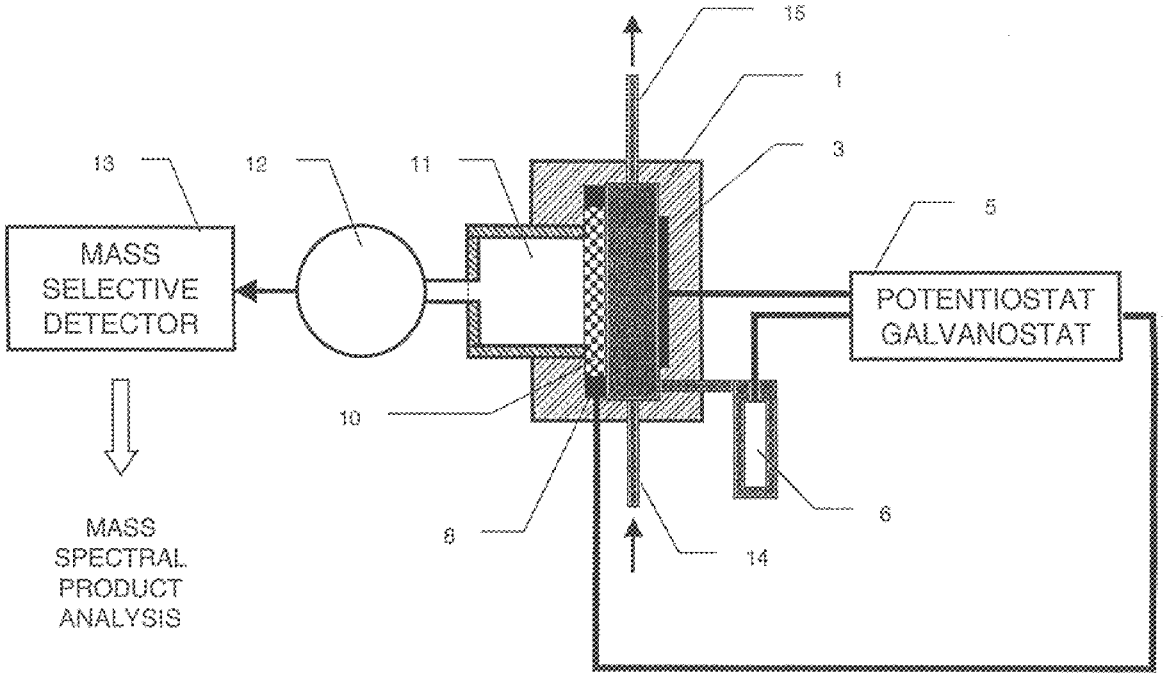
FIG. 2 illustrates an apparatus useful in the invention having an electrochemical cell, not to scale.

An alternate apparatus having an electrochemical cell useful in the invention is illustrated in FIG. 2, not to scale. Referring to FIG. 2, first chamber 1 contains a working electrode 3, reference electrode 6, auxiliary electrode 8, and membrane 10 separating the first chamber 1 from second chamber 11. Vacuum pump 12 connects the second chamber 11 with a mass selective detector 13. Working electrode 3, reference electrode 6 and auxiliary electrode 8 are connected to electrical power source 5. Electrolyte solution enters the first chamber 1 through inlet port 14 and exits through outlet port 15. Vacuum is applied to the second chamber 11 by vacuum pump 12 thereby reducing the pressure of the second chamber relative to the first chamber 1. A gas stream is thus provided passing from the first chamber 1 through membrane 10 into second chamber 11 and at least a portion of such gas stream is directed to the mass selective detector 13 for spectral analysis.

A wide variety of working electrodes may suitably be used. The working electrode may be constructed of a noble metal such as gold or platinum, or the base metal of the electroplating solution such as copper. The reference electrode has a stable, fixed voltage and may be used to control the potential of the working electrode in combination with a potentiostat (power source). The reference electrode may be made of any suitable material such as an insoluble metal salt in contact with the same metal. For example, suitable reference electrodes include the standard calomel electrode, $Hg/HgCl_2$ in KCl electrolyte. The auxiliary electrode may be made of any suitable material such as one of the noble metals including gold and platinum, or the base metal of the electroplating solution such as copper. A variety of power sources are suitable, including a galvanostat or a potentiostat. The inlet port draws a sample for analysis from an electroplating bath. Such sampling may be automated or performed manually and the sample introduced to the first chamber through the inlet port. After the analysis is performed, the sample exits the first chamber through the outlet port and the sample may be directed back to the electroplating bath or to a waste receptacle.

The present invention provides a method for determining the level of components in an electroplating bath including the steps of: a) obtaining a plurality of solutions wherein each solution has known and different concentrations of an analyte, but where the quantity of the analyte in each solution differs from the quantity in the other solutions; b) providing an apparatus having a first chamber and a second chamber, the first chamber being separated from the second chamber by a liquid-impermeable, gas-permeable membrane; c) introducing each solution individually into the first chamber and carrying out a predetermined sequence of steps including: i) reducing the pressure in the second chamber relative to the first chamber to produce a gas stream; ii) directing at least a portion of the gas stream to a mass spectrometer; iii) measuring a characteristic mass/charge peak for the analyte; d) for each solution, correlating the quantity of analyte with the measurement of the characteristic mass/charge peak; e) introducing a bath having an unknown quantity of the analyte into the first chamber; f) performing the predetermined sequence of steps; and g) choosing from the correlation in step d) a quantity of the analyte which corresponds to the recorded characteristic mass/charge peak measurement for the analyte.

Figure 3:
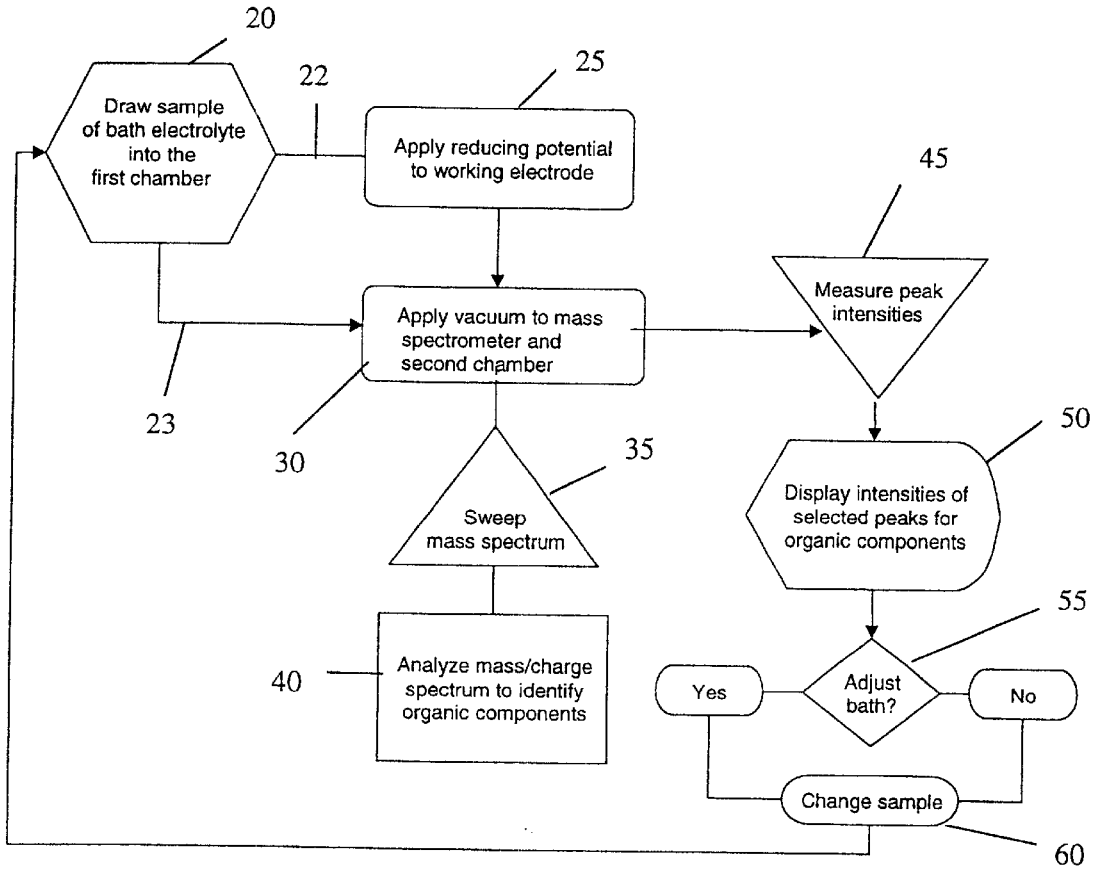
FIG. 3 is a flowchart illustrating the present method.

FIG. 3 is a flowchart illustrating the present method. At step 20, a sample or aliquot is taken from an electroplating bath containing one or more organic additives and placed in the first chamber of the apparatus. At this point, the sample may be analyzed with or without the application of a potential to the first chamber. Following the first route 22, a reducing potential is applied to a working electrode in the first chamber prior to applying a vacuum to the second chamber at step 30. By applying such reducing potential, the effect of an electroplating bath may be provided and organic species produced from such electrochemical operation may be analyzed directly. Alternatively, following route 23, a vacuum is applied to the second chamber at step 30 without any potential being applied to the working electrode. Applying vacuum to the second chamber produces a gas stream that is directed to a mass selective detector. At step 35, the mass spectrum is swept and the mass/charge spectrum analyzed to identify the organic components at step 40. A characteristic mass/charge peak, such as a parent ion peak, is typically monitored for each analyte. The mass/charge peak intensity is measured at step 45 and the intensities of selected peaks, such as a characteristic mass/charge peak, are displayed at step 50. The mass/charge ("m/e") peak intensity may be measured as peak height or peak area and may be displayed as either an analog or digital signal, and preferably a digital signal. Such displayed intensity for each organic additive of the electroplating bath is then compared to a preset value for that additive compound. If the displayed intensity falls below the preset value, the amount of the organic additive in the electroplating bath may need to be increased. In a fully automated system, when the intensity of the characteristic peak falls below the preset value, a computer can be employed to cause an appropriate amount of organic additive to be added to the electroplating bath. Following analysis of the solution in the first chamber, the solution is changed at step 60.

In the present method, a standard curve is first prepared for each organic additive, break down product, degradation product and the like (collectively "analytes") to be monitored. Such standard curves are obtained by first preparing a series of solutions containing known, but different amounts of analyte. Each solution has an amount of analyte that differs from the amount of analyte in the other solutions. A solution of the analyte is introduced into the first chamber of the apparatus and the pressure in the second chamber is then reduced relative to the first chamber. The reduced pressure produces a gas stream of the volatile analyte which passes from the solution through the membrane and into the second chamber. The gas stream is then directed toward the mass selective detector. The mass spectrum of the analyte is swept and the intensity of a characteristic mass/charge peak, typically of the parent ion, is measured. This procedure is then repeated for each of the analyte solutions of differing concentration. A correlation (i.e. standard curve, of peak measurement with quantity of analyte is then prepared. A solution of unknown quantity of analyte is then introduced into the first chamber of the apparatus and the above process steps repeated. The measurement of the characteristic mass/charge peak is then compared to the standard curve and the quantity of analyte in the solution is determined.

In an alternate embodiment, the apparatus may be an electrochemical cell, such as that shown in FIG. 2. In this embodiment, after the solution is introduced into the first chamber, a potential is applied to the working electrode. The potential is typically sufficient to reduce the metal ions in the bath to zerovalent metal. After the potential is applied, the pressure in the second chamber is reduced relative to the first chamber and the process is as described above. In this alternate method, a standard curve is first produced and then solutions of unknown quantities of analyte are analyzed and the characteristic mass/charge peak measurement is compared to the standard curve and the quantity of analyte in the solution is determined.

It will be appreciated by those skilled in the art that the present invention may be combined with one or more conventional bath metrology systems that employ techniques such as CVS, CPVS, OCP, or AC impedance.

The analysis of very small amounts of material is provided according to the present invention due to the sensitivity of the mass selective detector. If a particular component in the bath sample is present in high amounts, only a portion of the gas stream produced upon evacuation of the second chamber will be directed to the detector. If the particular component is present in only very low amounts, the entire gas stream produced may be directed to the detector. It will be appreciated by those skilled in the art that the amount of organic component in the gas stream is related to the partial pressure of the particular additive. One skilled in the art can easily determine the amount of the gas stream to be directed toward the detector.

The present invention further provides an electroplating system including an electroplating tank containing an electroplating bath, the tank having an outlet for directing a portion of the electroplating bath to an apparatus for determining the level of components in the electroplating bath, the apparatus including a first chamber separated from a second chamber by a liquid-impermeable, gas-permeable membrane, a means for reducing the pressure in the second chamber relative to the first chamber to produce a gas stream, and a means for directing at least a portion of the gas stream to a mass spectrometer.

A wide variety of electroplating baths may be analyzed according to the present method to determine the content of organic components, break down products, degradation products and the like in such baths. Suitable electroplating baths include, but are not limited to, those for depositing copper, nickel, chromium, zinc, tin, gold, silver, and their alloys. A metal electroplating bath typically contains a source of metal ions and an electrolyte. One or more organic components may optionally be added to the electroplating bath. Suitable optional components include, but are not limited to, halides, accelerators or brighteners, suppressors, levelers, grain refiners, wetting agents, surfactants, defoamers, ductilizers, and the like.

While the present invention may suitably be used with a variety of electroplating baths, it will be described with reference to a copper or copper alloy electroplating bath. A variety of copper salts may be employed in the typical electroplating solutions, including for example copper sulfates, copper acetates, copper fluoroborate, and cupric nitrates. Copper sulfate pentahydrate is a particularly preferred copper salt. A copper salt may be suitably present in a relatively wide concentration range in the electroplating compositions of the invention. Preferably, a copper salt will be employed at a concentration of from about 1 to about 300 g/L of plating solution, more preferably at a concentration of from about 10 to about 225 g/L, still more preferably at a concentration of from about 25 to about 175 g/L. It is preferred that the copper ion is present in the electroplating bath in an amount of from about 15 to about 50 g/L, and more preferably about 30 to about 45 g/L. The copper plating bath may also contain amounts of other alloying elements, such as, but not limited to, tin, zinc, indium, antimony, and the like. Thus, the copper electroplating baths useful in the present invention may deposit copper or copper alloy.

Plating baths useful in the present invention employ an electrolyte, preferably an acidic electrolyte. When the electrolyte is acidic, the acid may be inorganic or organic. Suitable inorganic acids include, but are not limited to, sulfuric acid, phosphoric acid, nitric acid, hydrogen halide acids, sulfamic acid, fluoroboric acid and the like. Suitable organic acids include, but are not limited to, alkylsulfonic acids such as methanesulfonic acid, aryl sulfonic acids such as phenylsulfonic acid and tolylsulfonic acid, carboxylic acids such as formic acid, acetic acid and propionic acid, halogenated acids such as trifluoromethylsulfonic acid and haloacetic acid, and the like. Particularly suitable organic acids include ($C_1$–$C_{10}$)alkylsulfonic acids. Preferred acids include sulfuric acid, nitric acid, methanesulfonic acid, phenylsulfonic acid, mixtures of sulfuric acid and methanesulfonic acid, mixtures of methanesulfonic acid and phenylsulfonic acid, and mixtures of sulfuric acid, methanesulfonic acid and phenylsulfonic acid.

It will be appreciated by those skilled in the art that a combination of two or more acids may be used. Particularly suitable combinations of acids include one or more inorganic acids with one or more organic acids or a mixture of two or more organic acids. Typically, the two or more acids may be present in any ratio. For example, when two acids are used, they may be present in any ratio from 99:1 to 1:99. Preferably, the two acids are present in a ratio from 90:10 to 10:90, more preferably from 80:20 to 20:80, still more preferably from 75:25 to 25:75, and even more preferably from 60:40 to 40:60.

The total amount of added acid used in the present electroplating baths may be from about 0 to about 100 g/L, and preferably from 0 to 50 g/L, although higher amounts of acid may be used for certain applications, such as up to 225 g/L or even 300 g/L. It will be appreciated by those skilled in the art that by using a metal sulfate as the metal ion source, an acidic electrolyte can be obtained without any added acid.

For certain applications, such as in the plating of wafers having very small apertures, it is preferred that the total amount of added acid be low. By "low acid" is meant that the total amount of added acid in the electrolyte is less than about 0.4 M, preferably less than about 0.3 M, and more preferably less than about 0.2 M. It is further preferred that the electrolyte is free of added acid.

The electrolyte may optionally contain one or more halides, and preferably does contain at least one halide. Chloride and bromide are preferred halides, with chloride being more preferred. A wide range of halide ion concentrations (if a halide ion is employed) may be suitably utilized, e.g. from about 0 (where no halide ion employed) to 100 ppm of halide ion in the plating solution, preferably from about 10 to about 75 ppm, and more preferably from about 25 to about 75 ppm. A particularly useful range of chloride ion is from about 10 to about 35 ppm.

A wide variety of brighteners and accelerators, including known brightener agents and accelerators, may be employed in the copper electroplating compositions of the invention. Typical brighteners and accelerators contain one or more sulfur atoms, and typically without any nitrogen atoms and a molecular weight of about 1000 or less. Brightener and accelerator compounds that have sulfide and/or sulfonic acid groups are generally preferred, particularly compounds that comprise a group of the formula R'—S—R—$SO_3X$, where R is an optionally substituted alkyl (which include cycloalkyl), optionally substituted heteroalkyl, optionally substituted aryl group, or optionally substituted heteroalicyclic; X is a counter ion such as sodium or potassium; and R' is hydrogen or a chemical bond (i.e. —S—R—$SO_3X$ or substituent of a larger compound). Typically alkyl groups will have from one to about 16 carbons, more typically one to about 8 or 12 carbons. Heteroalkyl groups will have one or more hetero (N, O or S) atoms in the chain, and preferably have from 1 to about 16 carbons, more typically 1 to about 8 or 12 carbons. Carbocyclic aryl groups are typical aryl groups, such as phenyl and naphthyl. Heteroaromatic groups also will be suitable aryl groups, and typically contain 1 to about 3 N, O or S atoms and 1–3 separate or fused rings and include e.g. coumarinyl, quinolinyl, pyridyl, pyrazinyl, pyrimidyl, furyl, pyrrolyl, thienyl, thiazolyl, oxazolyl, oxidizolyl, triazole, imidazolyl, indolyl, benzofuranyl, benzothiazol, and the like. Heteroalicyclic groups typically will have 1 to 3 N, O or S atoms and from 1 to 3 separate or fused rings and include e.g. tetrahydrofuranyl, thienyl, tetrahydropyranyl, piperdinyl, morpholino, pyrrolindinyl, and the like. Substituents of substituted alkyl, heteroalkyl, aryl or heteroalicyclic groups include e.g. $(C_1–C_8)$alkoxy; $(C_1–C_8)$alkyl, halogen, particularly F, Cl and Br; cyano, nitro, and the like.

More specifically, useful brighteners and accelerators include those of the following formulae:

$$XO_3S—R—SH$$

$$XO_3S—R—S—S—R—SO_3X$$

and $$XO_3S—Ar—S—S—Ar—SO_3X$$

where in the above formulae R is an optionally substituted alkyl group, and preferably is an alkyl group having from 1 to 6 carbon atoms, more preferably is an alkyl group having from 1 to 4 carbon atoms; Ar is an optionally substituted aryl group such as optionally substituted phenyl or naphthyl; and X is a suitable counter ion such as sodium or potassium.

Some specific suitable brighteners and accelerators include e.g. n,n-dimethyl-dithiocarbamic acid-(3-sulfopropyl)ester; 3-mercapto-propylsulfonic acid-(3-sulfopropyl)ester; 3-mercapto-propylsulfonic acid (sodium salt); carbonic acid-dithio-o-ethylester-s-ester with 3-mercapto-1-propane sulfonic acid (potassium salt); bissulfopropyl disulfide; 3-(benzthiazolyl-s-thio)propyl sulfonic acid (sodium salt); pyridinium propyl sulfobetaine; 1-sodium-3-mercaptopropane-1-sulfonate; sulfoalkyl sulfide compounds disclosed in U.S. Pat. No. 3,778,357; the peroxide oxidation product of a dialkyl amino-thiox-methyl-thioalkanesulfonic acid; and combinations of the above. Additional suitable brighteners are also described in U.S. Pat. Nos. 3,770,598, 4,374,709, 4,376,685, 4,555,315, and 4,673,469, all incorporated herein by reference. Particularly preferred brighteners for use in the plating compositions of the invention are n,n-dimethyl-dithiocarbamic acid-(3-sulfopropyl)ester and bis-sodium-sulfonopropyl-disulfide.

The amount of such brighteners or accelerators present in the electroplating baths is in the range of from about 0.1 to about 1000 ppm. Preferably, such compounds are present in an amount of from about 0.5 to about 300 ppm, more preferably from about 1 to about 100 ppm, and still more preferably from about 2 to about 50 ppm.

The suppressor agents useful in the compositions of the invention are polymeric materials, preferably having heteroatom substitution, particularly oxygen linkages. Generally preferred suppressor agents are generally high molecular weight polyethers, such as those of the following formula:

$$R—O—(CXYCX'Y'O)_nH$$

where R is an aryl or alkyl group containing from about 2 to 20 carbon atoms; each X, Y, X' and Y' is independently hydrogen, alkyl preferably methyl, ethyl or propyl, aryl such as phenyl; aralkyl such as benzyl; and preferably one or more of X, Y, X' and Y' is hydrogen; and n is an integer between 5 and 100,000. Preferably, R is ethylene and n is greater than 12,000.

The amount of such suppressors present in the electroplating baths is in the range of from about 0.1 to about 1000 ppm. Preferably, the suppressor compounds are present in an amount of from about 0.5 to about 500 ppm, and more preferably from about 1 to about 200 ppm.

Surfactants may optionally be added to the electroplating baths. Such surfactants are typically added to copper electroplating solutions in concentrations ranging from about 1 to 10,000 ppm based on the weight of the bath, more preferably about 5 to 10,000 ppm. Particularly suitable surfactants for plating compositions of the invention are commercially available polyethylene glycol copolymers, including polyethylene glycol copolymers. Such polymers are available from e.g. BASF (sold by BASF under Tetronic and Pluronic tradenames), and copolymers from Chemax.

Levelers may optionally be added to the present electroplating baths. It is preferred that one or more leveler components is used in the present electroplating baths. Such levelers may be used in amounts of from about 0.01 to about 50 ppm. Examples of suitable leveling agents are described and set forth in U.S. Pat. Nos. 3,770,598, 4,374,709, 4,376,685, 4,555,315 and 4,673,459. In general, useful leveling agents include those that contain a substituted amino group such as compounds having R—N—R', where each R and R' is independently a substituted or unsubstituted alkyl group or a substituted or unsubstituted aryl group. Typically the alkyl groups have from 1 to 6 carbon atoms, more typically from 1 to 4 carbon atoms. Suitable aryl groups include substituted or unsubstituted phenyl or naphthyl. The substituents of the substituted alkyl and aryl groups may be, for example, alkyl, halo and alkoxy.

More specifically, suitable leveling agents include, but are not limited to, 1-(2-hydroxyethyl)-2-imidazolidinethione; 4-mercaptopyridine; 2-mercaptothiazoline; ethylene thiourea; thiourea; alkylated polyalkyleneimine; phenazonium compounds disclosed in U.S. Pat. No. 3,956,084; N-heteroaromatic rings containing polymers; quaternized, acrylic, polymeric amines; polyvinyl carbamates; pyrrolidone; and imidazole. A particularly preferred leveler is 1-(2-hydroxyethyl)-2-imidazolidinethione.

The present invention may be used to analyze or monitor electroplating baths used for a wide variety of electroplating, such as plating of printed wiring boards, decorative plating, functional plating such as for corrosion resistance, plating of substrates used in the manufacture of integrated circuits, plating of connectors such as lead frames, plating of multichip modules, final finish plating and the like. It is preferred that the present invention is used with electroplating baths for depositing metal on a printed wiring board or a substrate used in the manufacture of integrated circuits.

Additionally, the present invention provides a method for electrolytically depositing metal on a substrate including the steps of: a) contacting the substrate with an electroplating bath including a source of metal ions, and electrolyte and one or more organic additives; b) subjecting the electroplating bath to sufficient current density for a period of time sufficient to deposit a desired thickness of metal on the substrate; and c) monitoring the one or more organic additives by i) obtaining a plurality of solutions wherein each solution has known and different concentrations of an organic additive, but where the quantity of the organic additive in each solution differs from the quantity in the other solutions; ii) providing an apparatus having a first chamber and a second chamber, the first chamber being separated from the second chamber by a liquid-impermeable, gas-permeable membrane; iii) introducing each solution individually into the first chamber and carrying out a predetermined sequence of steps including: aa) reducing the pressure in the second chamber relative to the first chamber to produce a gas stream; bb) directing at least a portion of the gas stream to a mass spectrometer; cc) measuring a characteristic mass/charge peak for the organic additive; iv) for each solution, correlating the quantity of organic additive with the measurement of the characteristic mass/charge peak; v) introducing a portion of the electroplating bath having an unknown quantity of the organic additive into the first chamber; vi) performing the predetermined sequence of steps; and vii) choosing from the correlation in step iv) a quantity of the organic additive which corresponds to the recorded characteristic mass/charge peak measurement for the organic additive. Preferably, such substrate is a wafer used in integrated circuit manufacture. Particularly suitable electroplating baths include copper and copper alloy baths.

What is claimed is:

1. A method for determining the level of one or more components in an electroplating bath comprising the steps of:

a) obtaining a plurality of solutions wherein each solution has known and different concentrations of an analyte, but where the quantity of the analyte in each solution differs from the quantity in the other solutions;

b) providing an apparatus having a first chamber and a second chamber, the first chamber being separated from the second chamber by a liquid-impermeable, gas-permeable membrane;

c) introducing each solution individually into the first chamber and carrying out a predetermined sequence of steps comprising:

i) reducing the pressure in the second chamber relative to the first chamber to produce a gas stream;

ii) directing at least a portion of the gas stream to a mass spectrometer;

iii) measuring a characteristic mass/charge peak for the analyte;

d) for each solution, correlating the quantity of analyte with the measurement of the characteristic mass/charge peak;

e) introducing a bath having an unknown quantity of the analyte into the first chamber;

f) performing the predetermined sequence of steps; and g) choosing from the correlation in step d) a quantity of the analyte which corresponds to the measured characteristic mass/charge peak measurement for the analyte.

2. The method of claim 1 wherein the analyte is selected from brightener, accelerator, suppressor, leveler and mixtures thereof.

3. The method of claim 1 wherein the electroplating bath is selected from copper, nickel, chromium, zinc, tin, gold, silver, and their alloys.

4. The method of claim 3 wherein the copper electroplating bath comprises a source of copper ions and an electrolyte.

5. The method of claim 4 wherein the electrolyte is acidic.

6. The method of claim 1 wherein the first chamber further comprises a working electrode, an auxiliary electrode and a reference electrode.

7. The method of claim 6 wherein a reducing potential is applied to the working electrode in step c) prior to step i).

8. The method of claim 1 wherein the membrane comprises an inert, non-conductive material.

9. The method of claim 1 wherein the pressure in the second chamber is reduced by application of a vacuum.

10. A method for electrolytically depositing metal on a substrate comprising the steps of:

a) contacting the substrate with an electroplating bath comprising a source of metal ions, and electrolyte and one or more organic additives;

b) subjecting the electroplating bath to sufficient current density for a period of time sufficient to deposit a desired thickness of metal on the substrate; and c) monitoring the one or more organic additives by i) obtaining a plurality of solutions wherein each solution has known and different concentrations of an organic additive, but where the quantity of the organic additive in each solution differs from the quantity in the other solutions;

ii) providing an apparatus having a first chamber and a second chamber, the first chamber being separated from the second chamber by a liquid-impermeable, gas-permeable membrane;

iii) introducing each solution individually into the first chamber and carrying out a predetermined sequence of steps comprising:

aa) reducing the pressure in the second chamber relative to the first chamber to produce a gas stream;

bb) directing at least a portion of the gas stream to a mass spectrometer;

cc) measuring a characteristic mass/charge peak for the organic additive;

iv) for each solution, correlating the quantity of organic additive with the measurement of the characteristic mass/charge peak;

v) introducing a portion of the electroplating bath having an unknown quantity of the organic additive into the first chamber;

vi) performing the predetermined sequence of steps; and vii) choosing from the correlation in step iv) a quantity of the organic additive which corresponds to the measured characteristic mass/charge peak measurement for the organic additive.

* * * * *